US005556093A

United States Patent [19]

Lankiewicz et al.

[11] Patent Number: 5,556,093

[45] Date of Patent: Sep. 17, 1996

[54] ONE PLAYER AIR CUSHION TABLE GAME WITH IMPROVED PUCK CAPTURE MECHANISM

[75] Inventors: Jeffrey R. Lankiewicz; Robert C. Schneider, both of Toms River; Gary J. Warner, Kendall Park, all of N.J.

[73] Assignee: Coin Concepts, Inc., East Brunswick, N.J.

[21] Appl. No.: 408,227

[22] Filed: Mar. 22, 1995

[51] Int. Cl.[6] ..... A63B 71/04

[52] U.S. Cl. ..... 273/126 A; 273/126 R; 273/127 R

[58] Field of Search ..... 273/126 R, 126 A, 273/127 R, DIG. 26, 123

[56] References Cited

U.S. PATENT DOCUMENTS

| | | | |
|---|---|---|---|
| 1,906,260 | 5/1933 | Gibbs . | |
| 1,986,152 | 1/1935 | Loaring | 273/123 |
| 2,722,421 | 11/1955 | Nicolaus | 273/126 A |
| 2,914,327 | 11/1959 | Gineta . | |
| 2,931,656 | 4/1960 | Hooker | 273/126 A |
| 3,063,719 | 11/1962 | Rosenberger | 273/126 A |
| 3,275,324 | 9/1966 | Burnside . | |
| 3,384,375 | 5/1968 | Zifferblatt | 273/126 A |
| 3,970,310 | 7/1976 | Gryschuk . | |
| 4,173,341 | 11/1979 | Olliges . | |
| 4,647,043 | 3/1987 | Wiczer | 273/121 R |
| 4,862,322 | 9/1989 | Krutsch | 273/121 R |
| 5,071,127 | 12/1991 | Bromley et al. | 273/126 AX |
| 5,110,128 | 5/1992 | Robbins | 273/126 A |
| 5,161,801 | 11/1992 | Kazuk | 273/126 A |
| 5,222,737 | 6/1993 | Kazuk | 273/126 A |

*Primary Examiner*—Raleigh W. Chiu
*Attorney, Agent, or Firm*—Richard C. Woodbridge

[57] ABSTRACT

An air cushion table game includes a barrier for deflecting a puck during the play of the game when the barrier is in the down position and for capturing the puck by permitting said puck to pass under the barrier when the barrier is up at the end of the game. A plurality of targets are located at the goal end of the game. The player attempts to accumulate as large a score as possible by striking the targets at the goal end of the game with a puck driven by a striker. A coin or token operated mechanism initiates the play of the game. According to the preferred embodiment of the invention, the game has four illuminated target areas each of which includes an LED/photosensor for sensing whether or not the illuminated area is hit by a puck. Alternatively, the game may comprise three targets each of which is randomly illuminated by a pair of red and green lights. Green illumination indicates that target will provide a positive value whereas a red light indicates that the player will decrease his or her cumulative score. The score is indicated on a scoreboard in the form of a volcano having progressive fields or bands starting at the bottom and going toward the top. A prize dispenser dispenses a prize or ticket to the player depending upon the cumulative score achieved when the play of the game has ended.

20 Claims, 11 Drawing Sheets

ONE PLAYER AIR CUSHION TABLE GAME WITH IMPROVED PUCK CAPTURE MECHANISM

BACKGROUND OF THE INVENTION

1. Field of the Invention

This invention relates to a coin operated redemption game played on a low friction, air cushion playing surface and including a moveable barrier for capturing a puck after play of the game has finished.

2. Description of Related Art

The game of "Air Hockey™" is a well known, two player game and is described in the prior art literature and in U.S. Pat. Nos. such as 3,773,325 and 3,887,187. Two players are typically located at opposite ends of a playing surface which includes an array of small holes through which pressurized air is pumped. A puck, in the form of a flat disk, can float over the cushion of air with relatively little or no friction. A striker or a mallet is used to hit the puck. The players at opposite ends of the playing surface attempt to defend their goal from the puck driven by their opponent.

While the use of two player air cushion games is fairly well known, its implementation as a one player game, especially in the context of coin operated machines, is relatively limited. In that regard, U.S. Pat. No. 5,110,128 entitled "AIR CUSHION TABLE GAME", discloses a one player, coin operated game for use in conventional game or redemption arcades. The player uses a mallet to hit a puck which is driven over an air cushion surface to impact targets at the goal end of the playing surface. A barrier is employed to come down at the end of the game. The barrier includes a flexible rubber blade which permits the puck to slip under it so it does not return to the player. The play of the game can be made more challenging by placing an obstacle in front of the targets. While this approach has many advantages, it has disadvantages too. For example, a rubber blade is subject to wear and oxidation. Moreover, the excitement in the play of the game can diminish in view of the fact that the rebound "action" of the puck is not believed to be very quick.

Isolated, but possibly relevant concepts, can be found in other contexts. For example, U.S. Pat. No. 4,173,341 describes an air cushion game, similar to pin ball, including a display scoring mechanism at the far end. Also, U.S. Pat. No. 3,970,310 describes an electrically operated game in which targets may be randomly illuminated for a limited period of time during which the player attempts to hit the illuminated target with a projectile. U.S. Pat. No. 5,222,737 describes a puck style surface projectile game having a board display above the surface.

The following patents describe amusement games including scoring displays of possible relevance: 1,986,152; 1,906,260; 2,914,327; 3,275,324; 3,384,375; 3,063,719; and 5,071,127.

Insofar as is known and understood, none of the prior art, either taken individually or in combination, teaches or suggests a single player, air cushion game including a resilient barrier that moves up in order to capture the puck at the end of the game.

SUMMARY OF THE INVENTION

Briefly described, the invention comprises a one player, air cushion game. The player initially puts a coin or token into the apparatus and the machine delivers a puck to the player. The player has 25 seconds, which may be increased or decreased and is controlled by a timer mechanism, to make as many points as possible. The player makes points by hitting the puck with a striker so that it glides down the playing surface and hits a target at the other end. According to the preferred embodiment of the invention, there are four targets at the far, or goal, end of the playing surface that can be hit during the adjustable 25 second play of the game. At the beginning of the game, a barrier gate comes down at the far end behind the target areas. Each of the four target areas is illuminated by a white light. Four green lights located above the four illuminated spots help the player locate the four target areas. The player earns points by driving the puck over one of the four illuminated target areas during the adjustable 25 second play of game. The puck is detected as it passes over one of the four illuminated target areas by an LED/photosensor combination located between it and the resilient barrier.

According to an alternative embodiment, there might be three targets each illuminated by a pair of red and green lights. If the player hits one of the targets illuminated by a green light, the player gets a positive score, but if the target is illuminated by a red light, the player gets a negative score.

The total cumulative score is recorded on a volcano-like simulation display on the scoreboard at the goal end of the playing surface. The simulated volcano includes a plurality of successive scoring fields or bands, with the lower scoring field being located at the bottom closer to the target area of the playing surface. The object of the game is to increase the cumulative score in order to reach the top of the volcano thereby indicating the attainment of the maximum cumulative points possible. Each of the successive scoring fields include behind it a string of between one and four strings of lights which light up the scoring field in front of it. According to an alternative embodiment of the invention, the value of the targets can change randomly, as indicated by the illumination of red or green lights, so that one, two or three targets can be either green or red colored at any given time. The score can also be doubled up or down by hitting one of two targets located on the two opposite sides of the playing surface during play.

The score is kept on the vertical, volcano-like scoreboard. The player starts at the bottom in a blue band or scoring field and advances upward through the band. The player subsequently makes it to the pink band or field, then the red band, etc. until the player makes it all the way to the yellow zone or band at the top. As the player proceeds up the volcano, sound and light effects become progressively more vigorous and exciting. If the player makes it to the top of the volcano, the volcano erupts. Prizes are typically in the form of tickets which may be redeemed for real prizes later. Alternatively, the prizes may be dispensed in the form of a packet with a special prize inside. At the end of the adjustable 25 second game, the gate at the far end goes up which permits the puck to slip through the far end and become captured until the next player comes and places a coin or token into the machine. The puck is then released and returned back to the player.

Another feature of the invention is that if the player puts a coin or token into the machine within seven seconds, which can be adjusted to increase or decrease, after the end of play of the first game, then the player can continue to play the second game from where he or she left off during the previous 25 seconds. If, however, more than seven seconds elapse from the end of the first game, then the player starts the second game at the very bottom of the volcano.

These and other features of the invention may be more fully understood by reference to the following drawings.

DETAILED DESCRIPTION OF THE INVENTION

During the course of this description like numbers will be used to indicate like elements according to the different figures that illustrate the invention.

Figure 1:
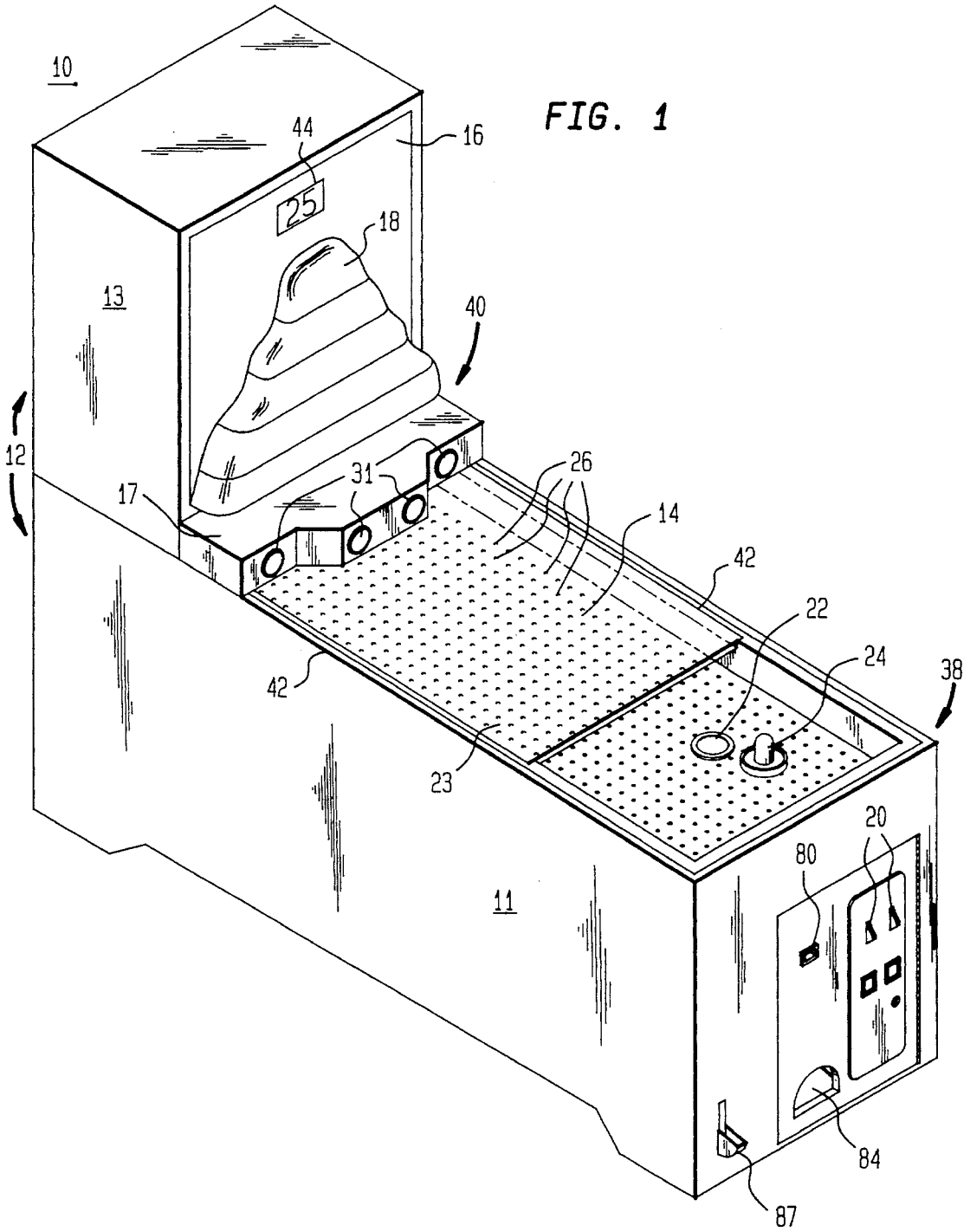
FIG. 1 is a front, perspective view of the improved one player, air cushion table game according to the preferred embodiment of the invention.

The preferred embodiment of the improved one player, air cushion table game apparatus 10 is illustrated in FIG. 1. The game 10 is housed in a console 12. Console 12 includes a lower portion 11 connected to an upper portion 13 by a hinge 99 which permits the upper portion 13 to be folded over and on top of lower portion 11 for shipping. The primary exterior features of the game apparatus 10 are a playing surface 14 and a scoreboard 16. The playing surface 14 has a goal or target end 40, two sides 42 and a player end 38. A display in the form of a simulated volcano 18 located above a platform or shelf 17 provides a visual indication of the cumulative score of the player and, therefore, an indication of the progress of the game.

The game is initiated when a player places a coin or token into the coin slot 20. That activates coin mechanism 21 which turns on microprocessor sub-assembly 56 that includes an electronic timing mechanism incorporated in an electronic controller 54, both illustrated in the electrical schematic of FIG. 2A. The microprocessor sub-assembly 56 is substantially identical to the sub-assembly in the commercially available game called "Home Run Hitter" available from Coin Concepts, Inc. of East Brunswick, N.J. Air, propelled by a blower 78, is forced through small air holes 26 in the playing surface 14. A strikeable projectile, in the form of a flat disc, or puck 22, is released to the player at the beginning of the game. Puck 22 is struck with a striker 24, or mallet in the conventional manner. A hard, clear plastic sheet 23 keeps the player from coming too close to the goal end 40 of the playing surface during play of the game.

Figure 3A:
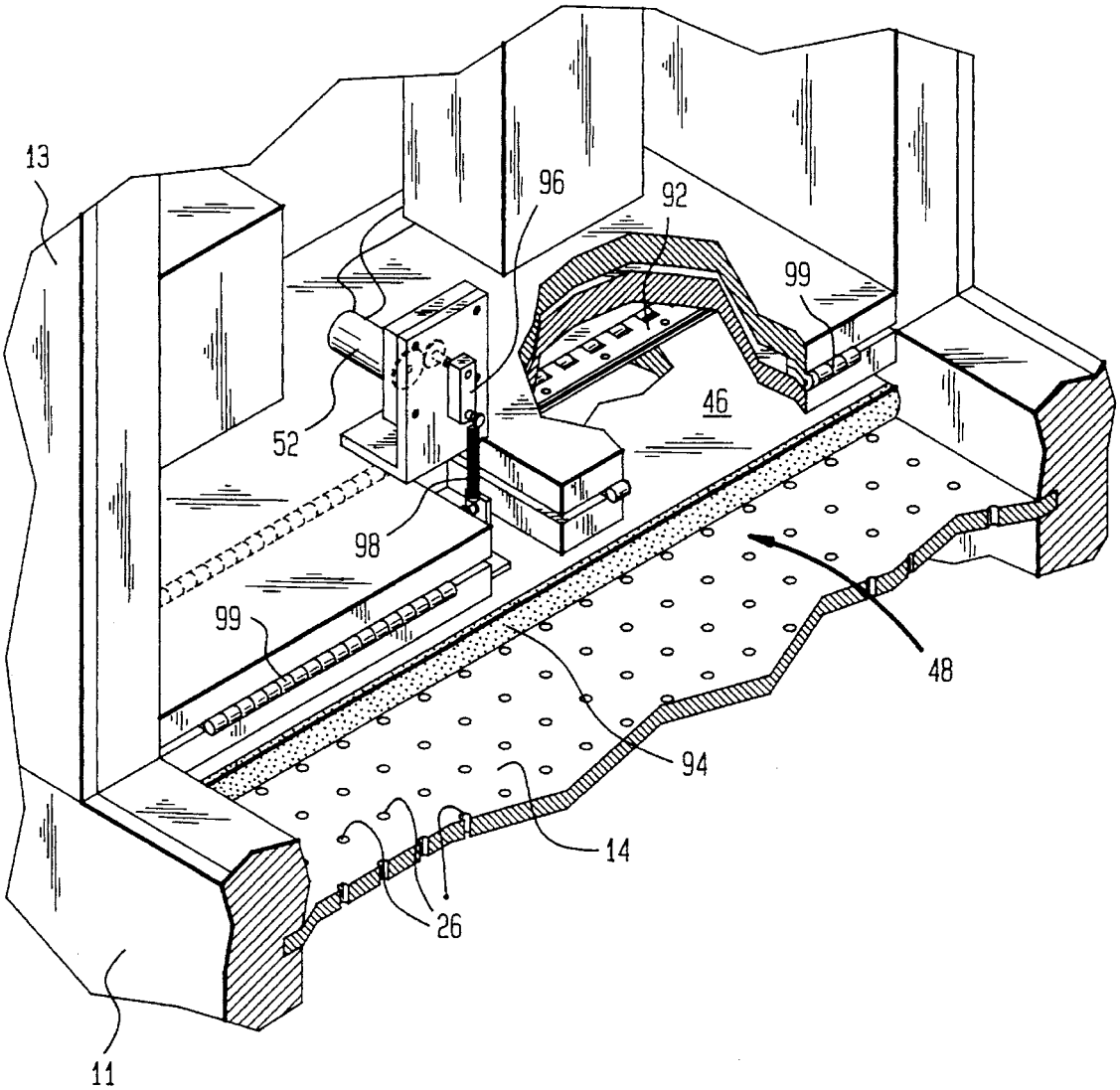
FIG. 3A illustrates the deflector bar in its first, or down, position where it is located during the play of the game.
Figure 3B:
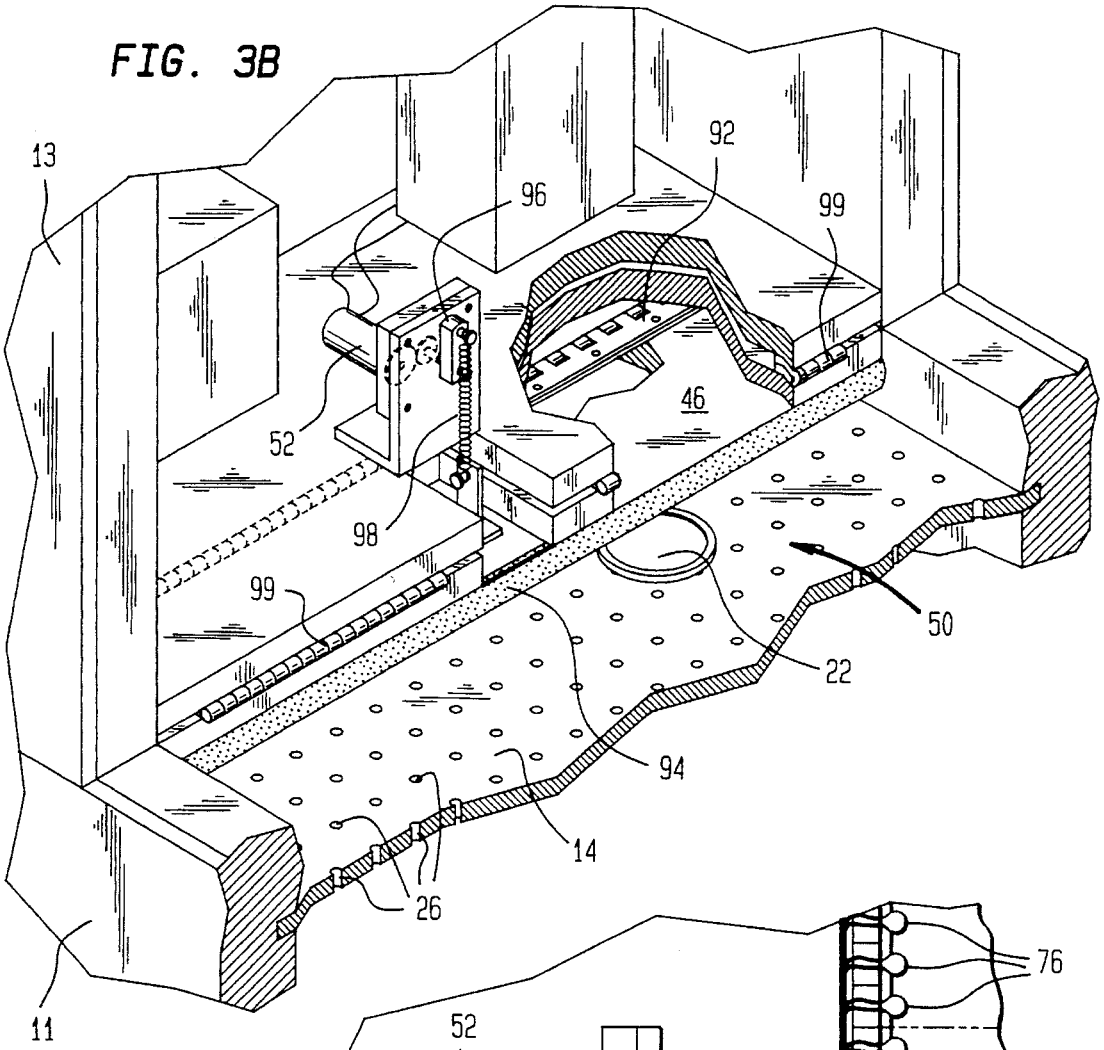
FIG. 3B illustrates the deflector bar in its second, or up, position at the end of the game so that the puck can pass under it.
Figure 3C:
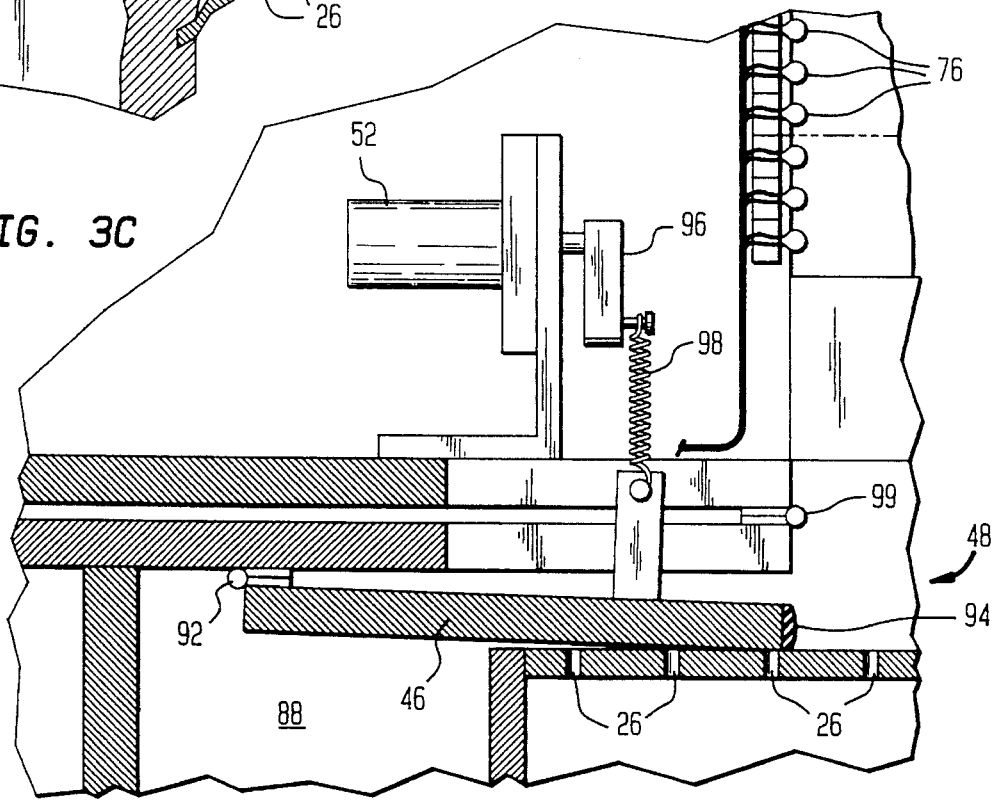
FIG. 3C is a detail view of the drive mechanism for the deflector bar illustrated in FIGS. 3A and 3B.
Figure 4A:
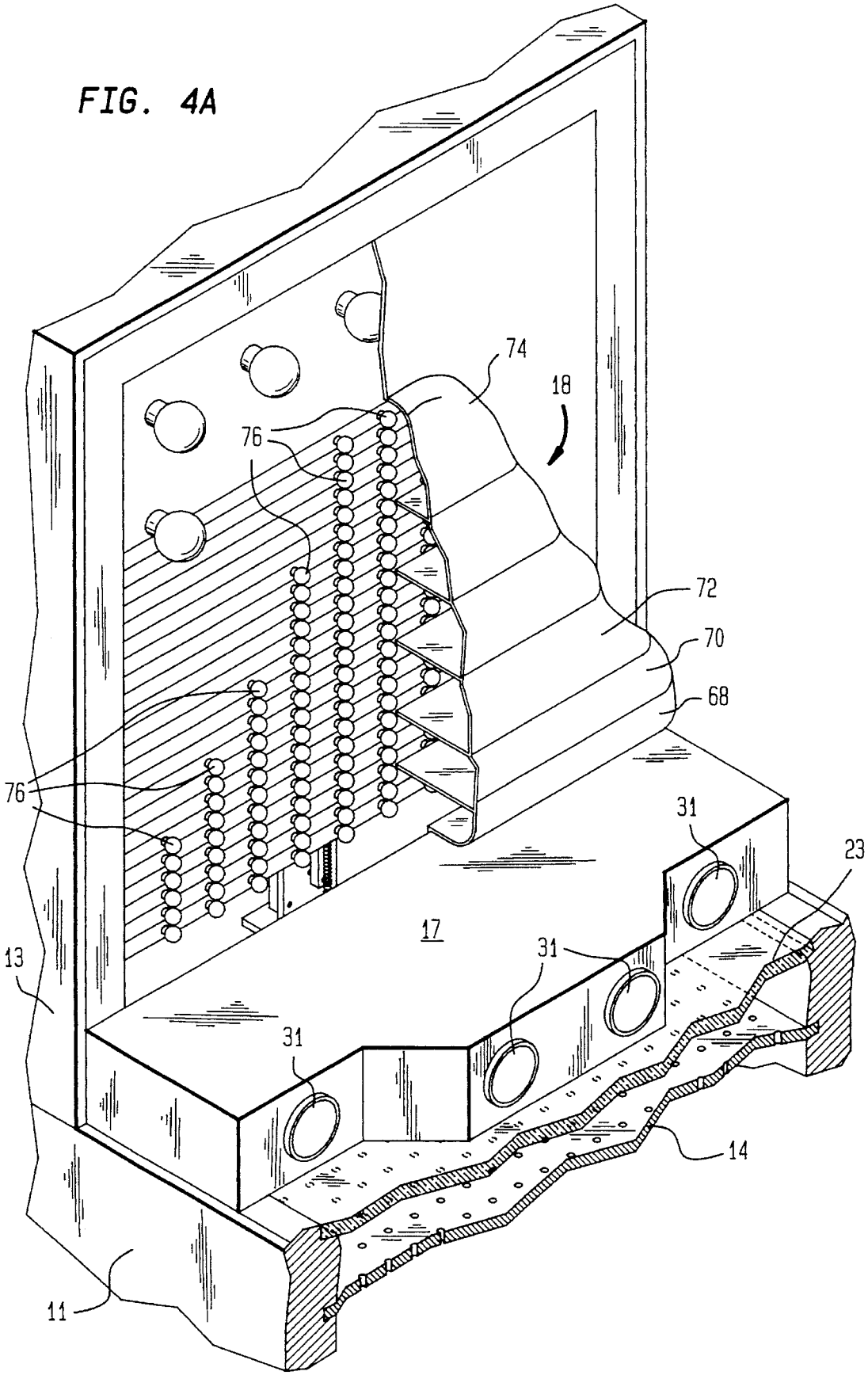
FIG. 4A illustrates the volcano scoreboard display at the beginning of the game.
Figure 4B:
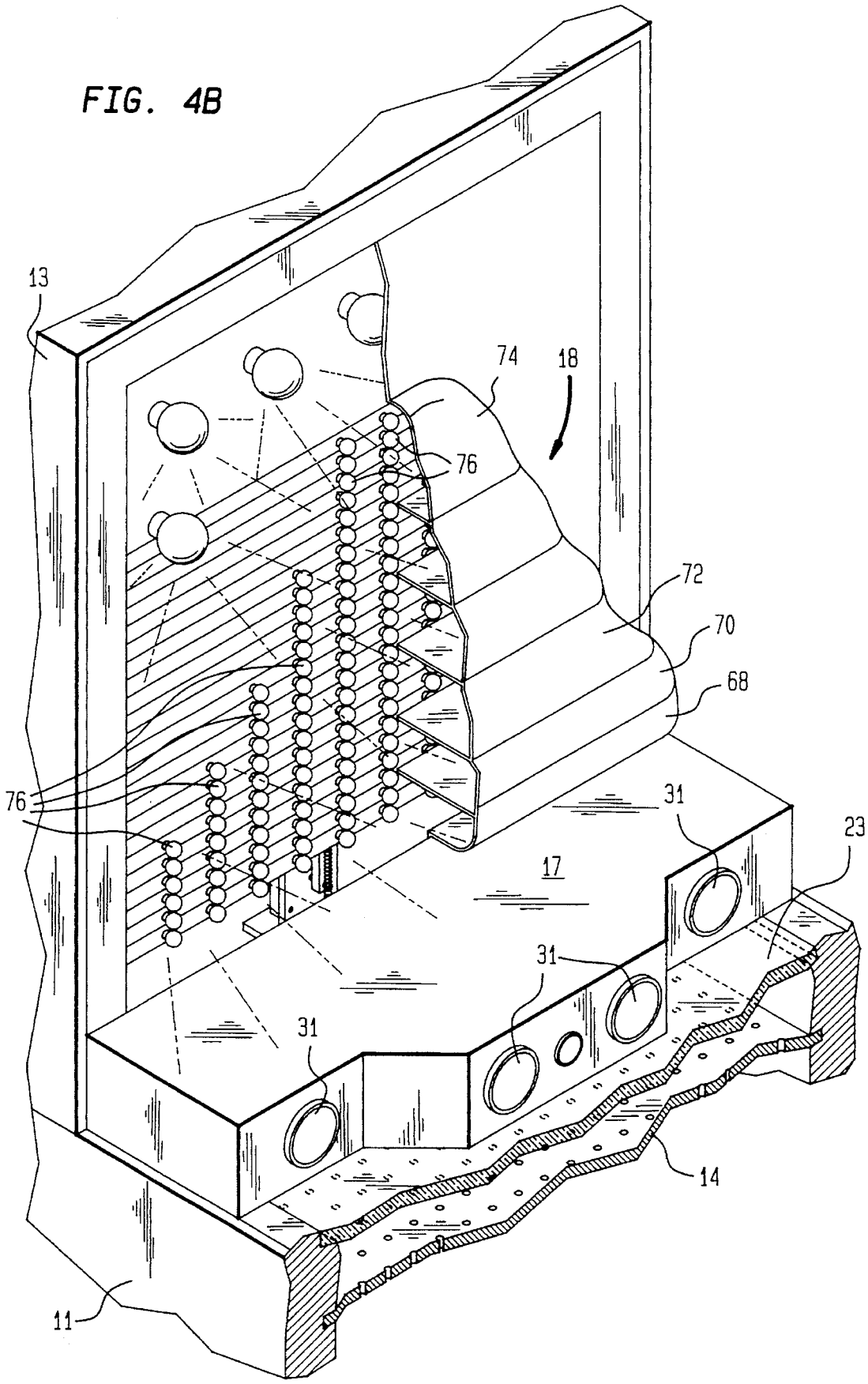
FIG. 4B illustrates the volcano scoreboard display at the end of the game after a player has accumulated the maximum possible score.
Figure 8:
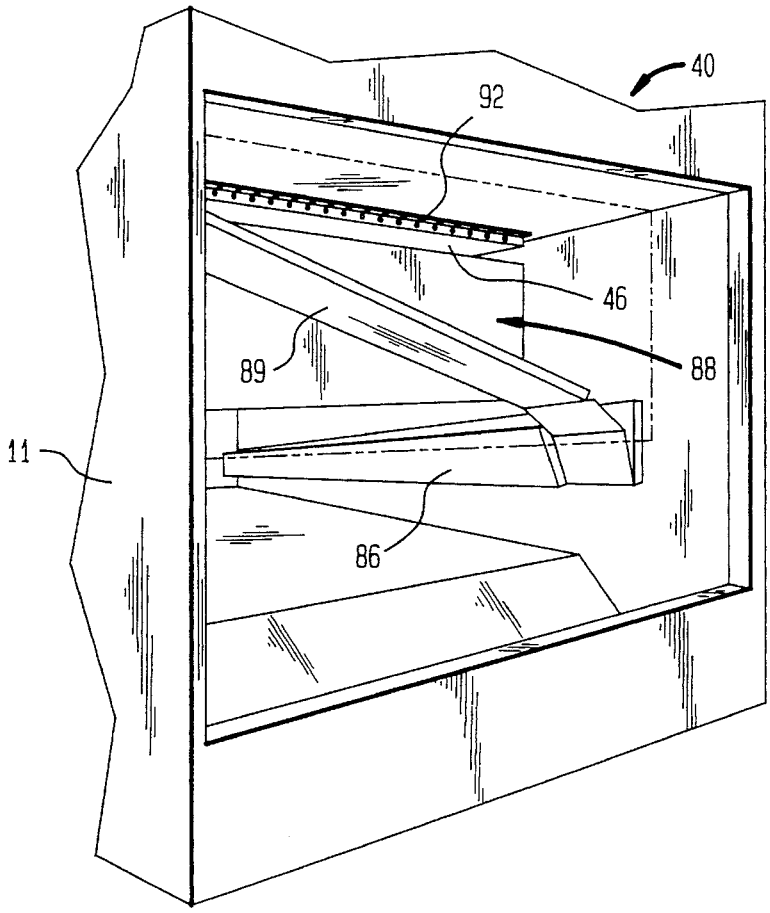
FIG. 8 is a rear view of the invention with the back panel removed illustrating the puck collecting bin which includes a sloping floor and the puck return chute which received the puck from the bin.

According to the preferred embodiment 10 of the invention, a barrier gate, or boom 46, always remains in an up, or second position 50, prior to the play of the game as shown in FIG. 3B. After play of the game is initiated by the player placing a coin or token into the coin slot 20, the electronic controller circuit 54 causes the microprocessor sub-assembly 56 to signal the barrier gate motor 52 to turn. Puck gate motor 52 includes a drive crank 96 and a spring link 98 which is connected to the top of the barrier gate 46 as shown in FIGS. 3A, 3B and 3C. Rotation of the crank 96 and link 98 causes the gate 46 to descend to a first, or down position 48 at the beginning of the game as shown in FIG. 3A. Barrier gate 46 includes a resilient bumper strip 94 on the vertical face thereof which actively reflects the puck 22 back to the player during play. This is very important because the resilient play of the game makes the game faster and exciting for the player. Barrier 46 is connected by a hinge 92 to the back of the upper section 13 of the console 12 so that it can rotate selectively between its first, or down position 48 and its second, or up position 50. At the end of the 25 second play of the game which time period may be adjusted, and as indicated by game timer display 44, the barrier gate 46 moves up to its second position 50. This creates an opening under the barrier 46 to permit the puck 22 to pass thereunder. When that happens the puck 22 drops into a bin 88 directly behind the goal end 40 of the playing surface 14 which delivers it to inclined puck chute 86. Puck collection bin 88 includes an inclined base or sloping floor 89 illustrated in detail in FIG. 8. Puck 22 then rolls down the puck chute 86 to a solenoid operated puck release gate mechanism 90. Solenoid operated puck release gate mechanism 90 includes two portions of a fork-like mechanism that selectively deliver a puck 22 to a player at the beginning of the game while at the same time setting up a second puck 22 for delivery to the next player. A small puck stop 87 located at the end of puck chute 86 prevents the puck 22 from rolling out onto the floor. As previously described, however, if the player places a coin or token in the coin slot 20 thereby activating the coin mechanism within seven seconds of the end of the first game, the player can continue to score from the point where he or she stopped in the first game. If, however, the player waits for more than seven seconds, then the player must start from the very beginning at the very lowest band 68 on the volcano 18. The barrier gate 46 remains in the first, or down position 48 during the 25 second play of the game (or its extension). After the game is over the barrier gate 46 moves back to its second, or up position 50, until such time as play is reinitiated by placing another coin or token in coin slot 20.

Figure 2A:
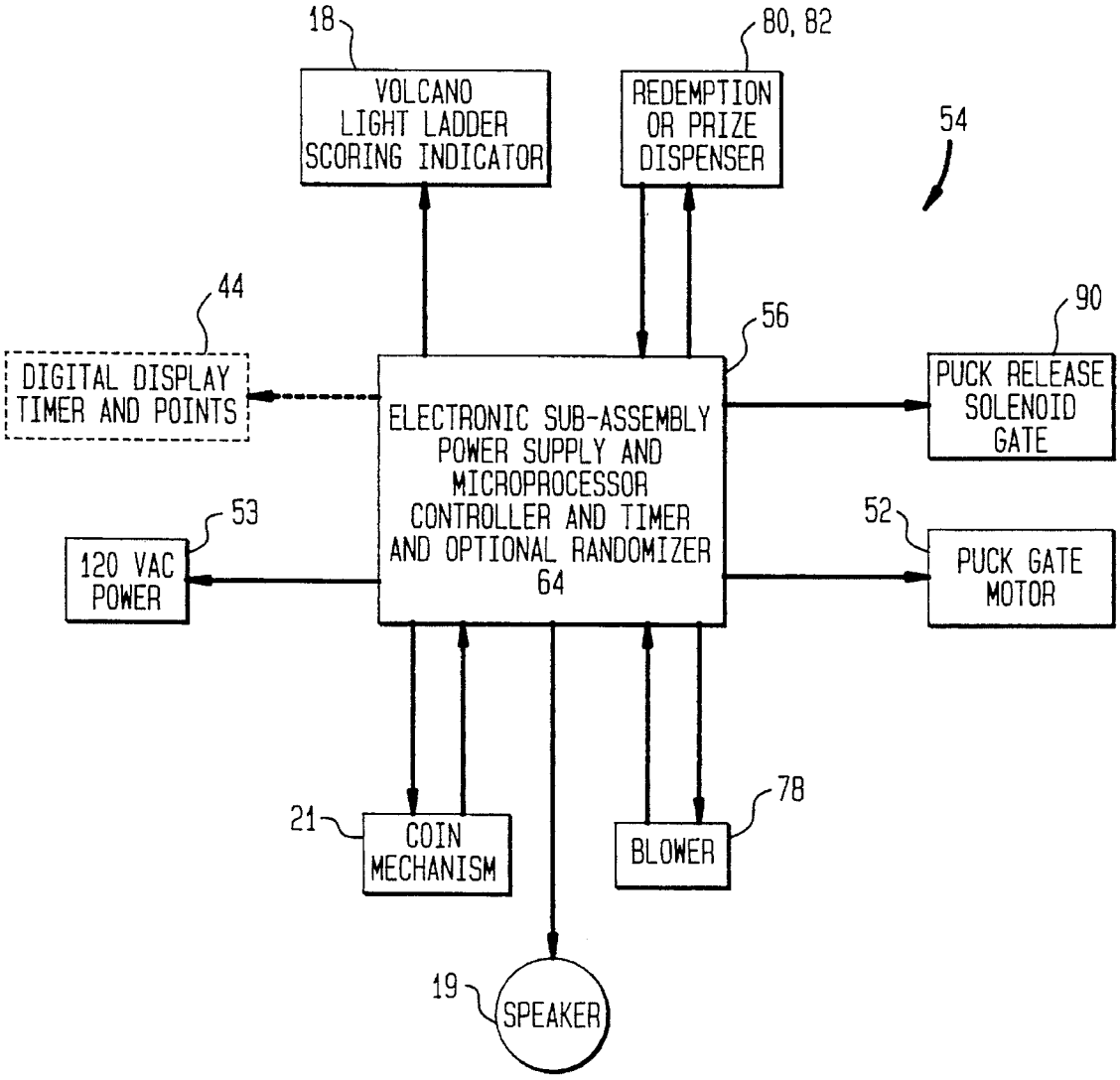
FIG. 2A is an electrical schematic describing the electronics which control the game illustrated in FIG. 1.
Figure 2B:
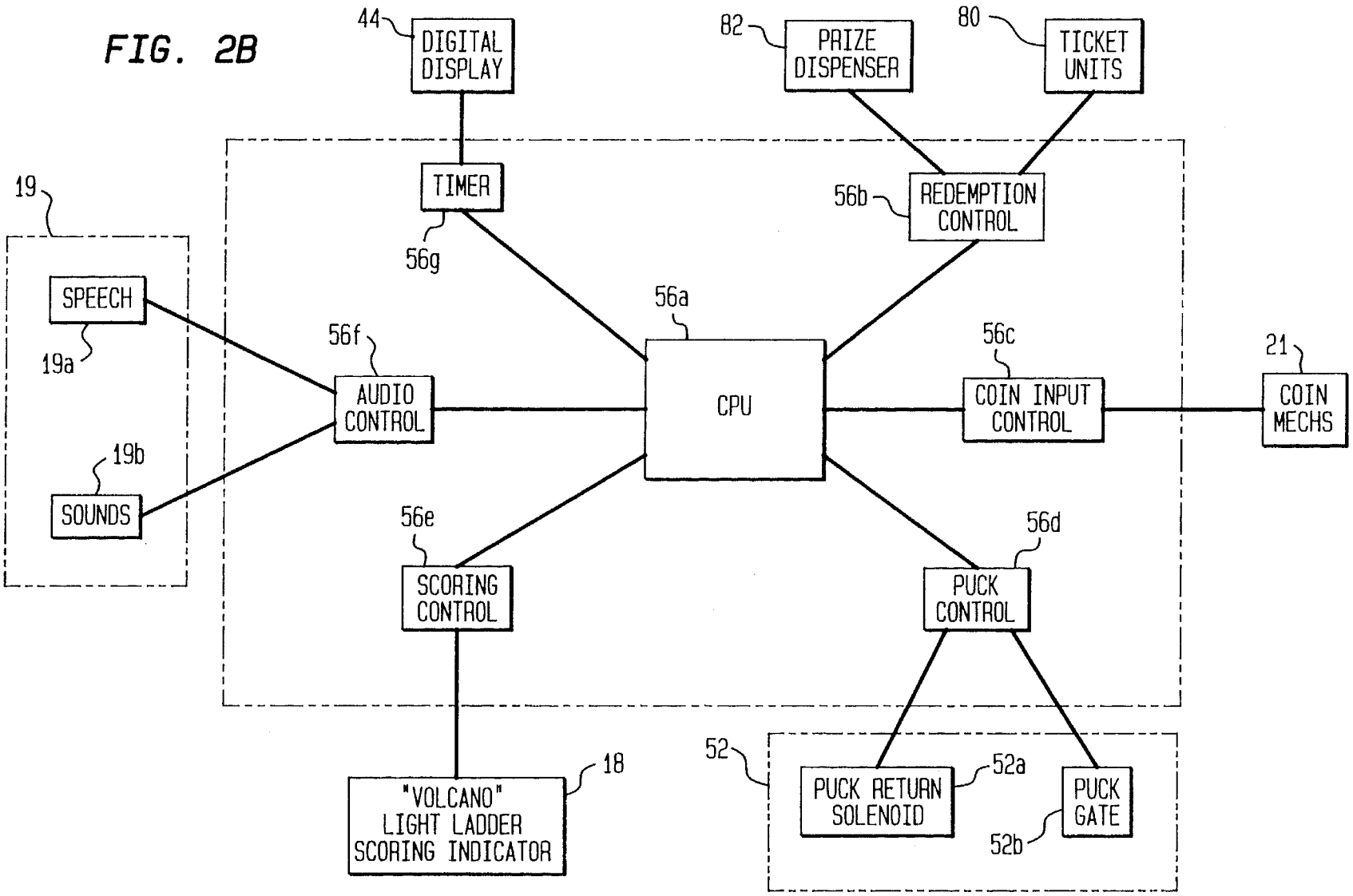
FIG. 2B is an electrical schematic describing in further detail the microprocessor sub-assembly illustrated in FIG. 2A.
Figure 5:
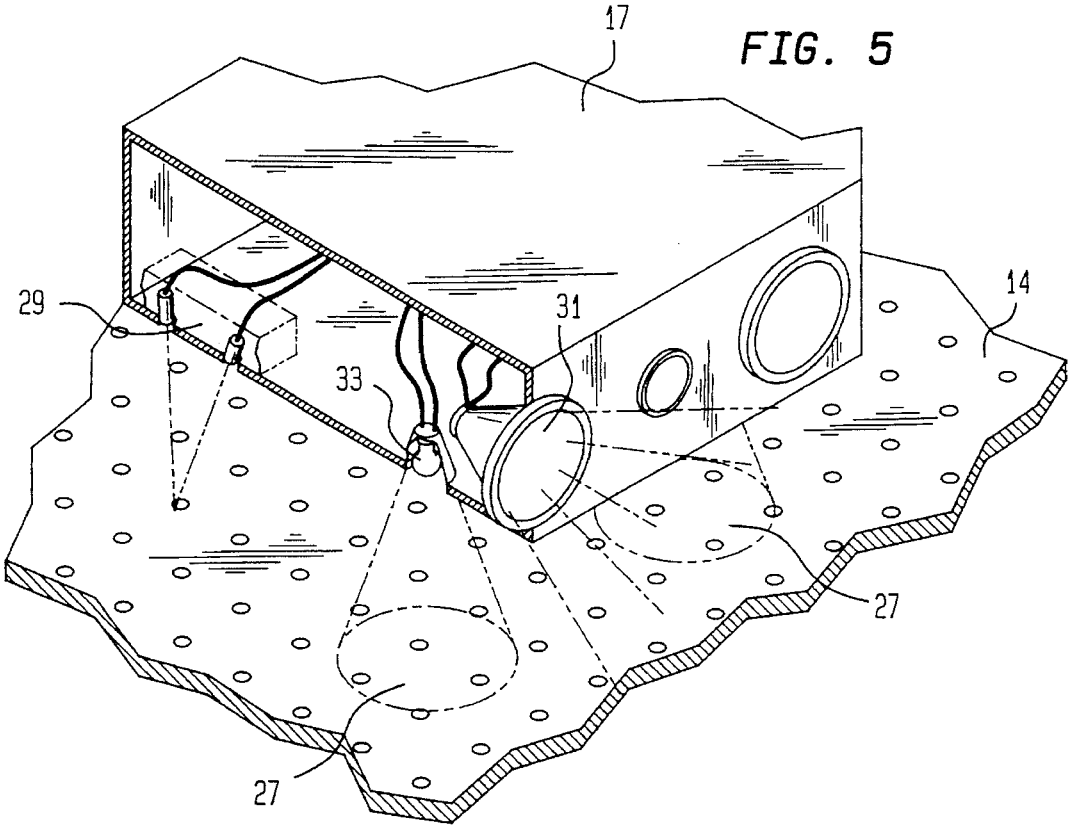
FIG. 5 is a detailed view of one of the four target areas of the preferred embodiment of the invention.

The electronic controller mechanism 54, illustrated in FIG. 2A controls the electronic components that in turn control the preferred embodiment of the invention 10. Placing a coin or token in coin slot 20, activates the coin mechanism 21, which in turn activates the electronic microprocessor sub-assembly and timer 56. The electronic microprocessor sub-assembly and timer 56, described in further detail in FIG. 2B, is substantially identical to the controller and timer used in a commercially available game known as "HOME RUN HITTER" sold by Coin Concepts, Inc. of East Brunswick, N.J., as previously mentioned. Activation of microprocessor sub-assembly 56 turns on the air supply blower 78 and releases a puck 22 by activating the puck release solenoid gate 90. Simultaneously, the digital display 44 indicates that 25 seconds are available for play of the game. The controller circuit 54 and its associated elements are powered by a 120 volt AC power supply 53 in a conventional manner. The player plays the game for an adjustable 25 second period and his or her score is recorded on the volcano ladder-like scoring indicator 18. At the end of the game, the player receives a ticket from ticket dispenser 80 or a prize that slides down prize chute 84 from prize dispenser 82 shown in FIG. 9 depending upon the set-up of the game. Prior to play of the game the barrier gate 46 is in its second, or up, position 50 shown in FIG. 3B. During the adjustable 25 second play of the game the barrier gate 46 is in its first or down position 48 shown in FIG. 3A. If, within seven seconds of the end of the adjustable 25 second play of the first game, the player places another coin or token into the coin slot 20, then play of the second game resumes from where the player had left off in the first game. If, however, the player did not place a coin or token into the coin slot 20 during the seven second grace period after the 25 second play of the first game, then the player starts the play of the second game from the very beginning at the bottom band or scoring field 68. After play of the game is over, the microprocessor sub-assembly 56 causes the puck gate motor 52 to drive the barrier gate 46 into its second, or up, position 50 thereby permitting the puck 22 to be collected in bin 88, and returned down the puck shoot 86 to the puck release gate and solenoid mechanism 90. The microprocessor sub-assembly 56 totals up the number of "hits" that a player makes as the puck 22 passes over the four illuminated target areas 27. The target areas 27 are illuminated by a commercially available light or lamp 33 as shown in FIG. 5. Each time a puck 22 passes over one of the four illuminated target areas 27, it interrupts a light beam from a commercially available LED/photosensor combination unit 29 which, in turn, records a score on the volcano 18. A green light 31, preferably located in front of each of the illuminated target areas 27, indicates to the player where the target areas 27 are located. A speaker 19 driven by commercially available sound card technology in microprocessor sub-assembly 56 provides suitable audio sound effects appropriate for any particular stage of the game.

Figure 7B:
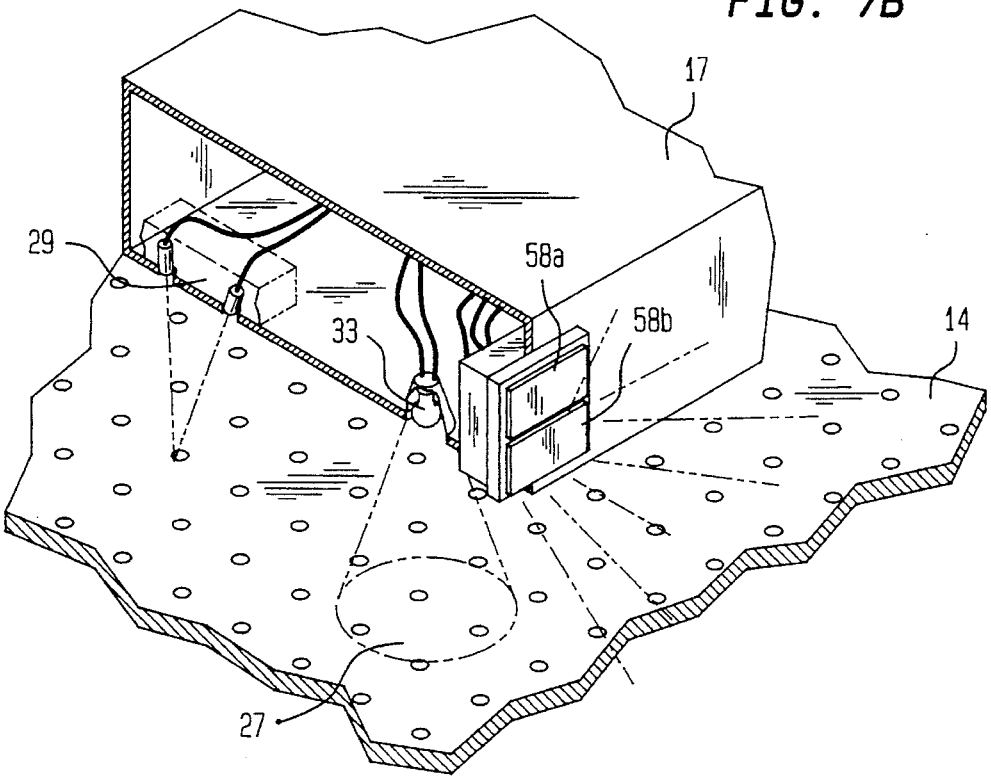
FIG. 7B is a detail view illustrating a single pair of red and green lights according to the alternative embodiment of the invention as they illuminate a single target at the goal end of the playing surface.
Figure 6:
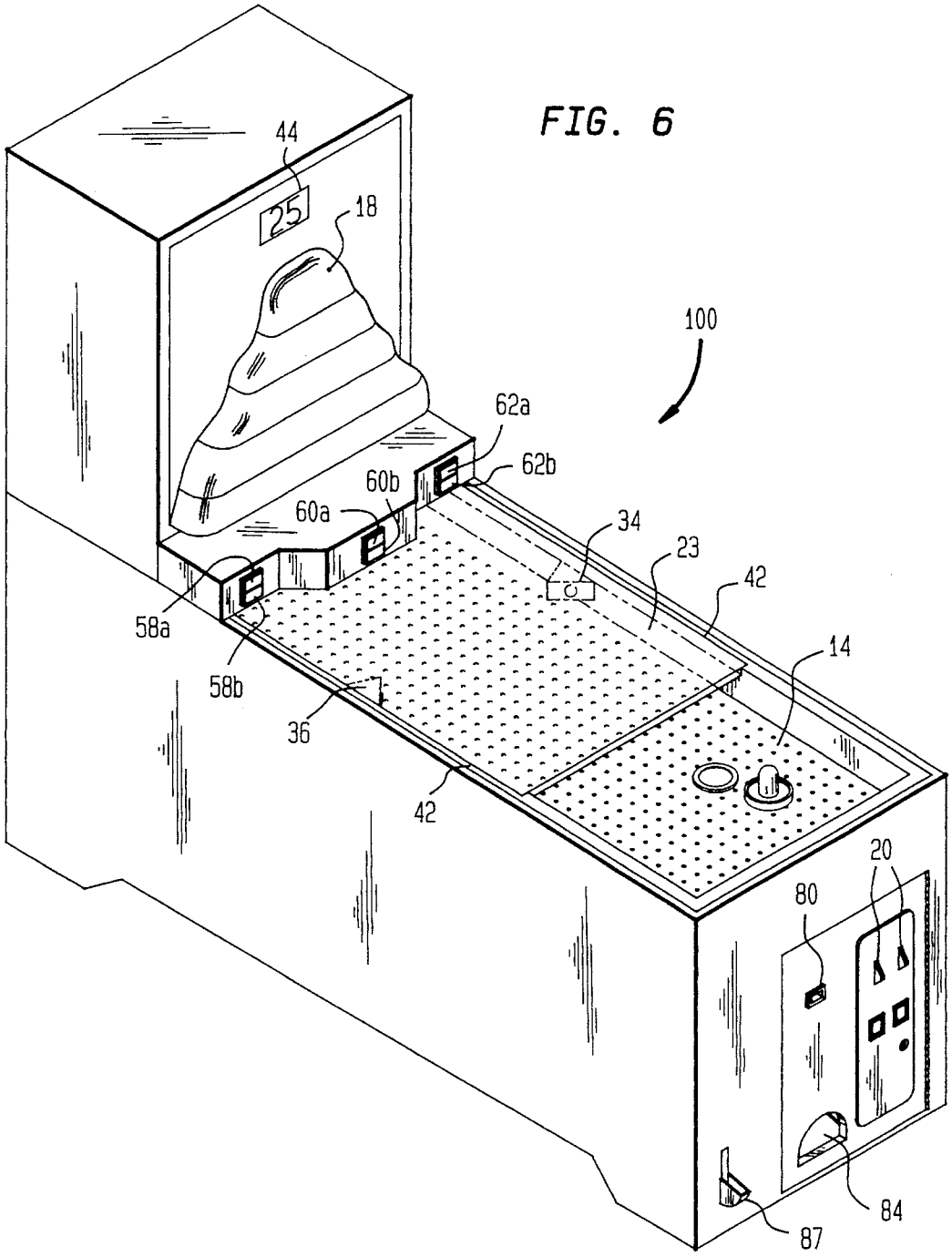
FIG. 6 is a front, perspective view of an alternative embodiment of the one player, air cushion table game, which includes a mechanism for randomizing the value and scoring of three targets during play of the game.
Figure 7A:
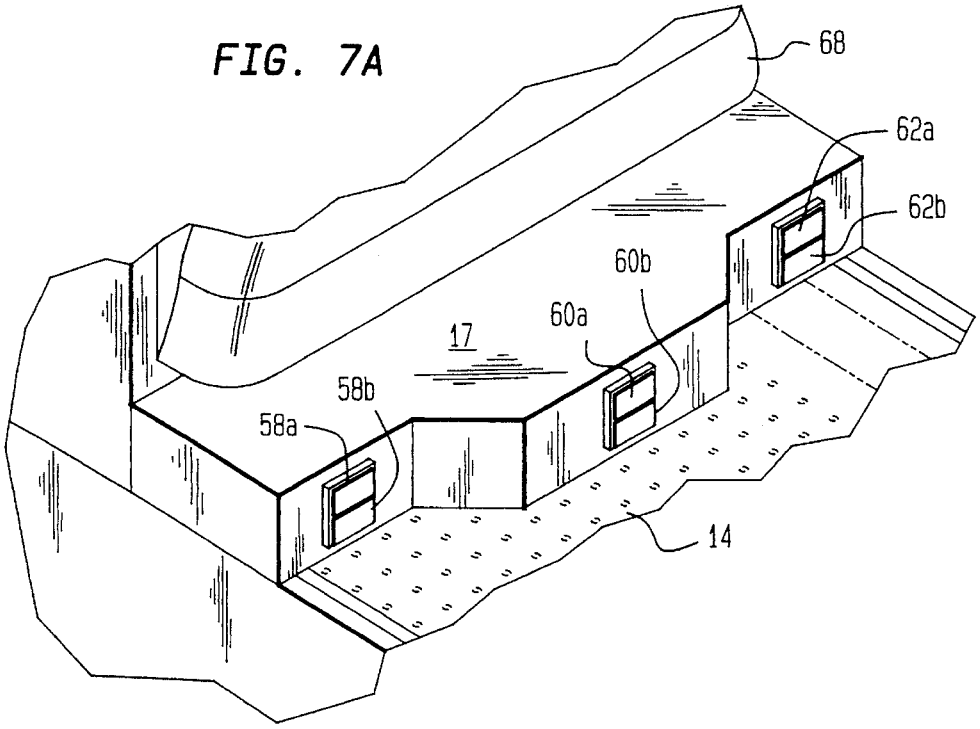
FIG. 7A illustrates the three targets of the alternative embodiment of the invention as illuminated by three separate pairs of red and green lights respectively.

According to an alternative embodiment of the invention 100, instead of having four illuminated target areas 27, the targets may comprise three target areas 28, 30 and 32 which are each illuminated with pairs of red and green lights 58, 60 and 62 as shown in FIGS. 7A and 7B. A green light 58*a*, 60*a* and 62*a* indicates that the value of the target area 27 is positive whereas a red light 58*b*, 60*b* and 62*b* indicates that the value of the target area 27 is negative. If one of the side targets 34 or 36 located on either side 42 of playing surface 14 as shown in FIG. 6, is struck during the play of the game, then the value of the targets 28, 30 and 32 doubles. A randomizer 64 driven by the microprocessor sub-assembly 56, according to techniques and software that are well known to those of ordinary skill in the art, can change the value of the targets 28, 30 and 32 as indicated by their red or green illumination.

One of the very useful features of the present invention 10 and 100 is that the upper section 13 of the console 12 is connected by a hinge 99 to lower section 11 of the console 12. This permits the upper section 13 of the console 12 to be rotated downwardly onto the lower section 11 so that the entire invention 10 or 100 can be shipped as a single unit.

FIG. 5 illustrates in detail one of the four illuminated target areas 27 according to the preferred embodiment 10 of the invention. A green light 31 indicates to the player the approximate location of the illuminated target areas 27. A conventional, commercial available LED/photosensor combination unit 29 located directly behind the illuminated target area 27 but ahead of the resilient barrier gate 46, senses the presence of the puck 22 during the adjustable 25 second play of the game.

FIG. 6 illustrates an alternative embodiment of the invention 100 which includes, as previously described, three targets switches 28, 30 and 32 whose values may randomly or pseudo randomly change during the game. As illustrated in FIGS. 7A and 7B, target 28 is illuminated by a pair 58 of green 58*a* and red 58*b* lights. Similarly, targets 30 and 32 are illuminated by a pair 60, 62 of green 60*a*, 62*a* or red 60*b*, 62*b* lights, respectively. Whether a green light 58*a*, 60*a*, 62*a* or a red light 58*b*, 60*b*, or 62*b* is illuminated depends upon the signal from the randomizer 64 in the microprocessor sub-assembly 56. It is possible for all three targets 28, 30 or 32 to be illuminated red, or green, or any combination of red or green depending upon the signals provided to light pairs 58, 60 and 62.

The volcano-like simulation 18 on the scoreboard 16 indicates the cumulative score achieved by a player during the adjustable 25 second play of the game. The volcano simulation 18 includes a plurality of multiple, progressive scoring fields, 3 zones or bands 68, 70, 72, 74, etc. The lowest scoring field, preferably colored blue, is field 68. If the player achieves the cumulative value greater than that indicated in the lower field 68, then he or she progresses onto the next field 70. The lower field might, for example, be blue, the next field 70 might, for example, be pink, the next 72 might be red, and so on, and the top 74 might be yellow. Each of the progressive fields 64–72 is illuminated between one and four light strings 76. For example, the bottom, or blue, field 68 might include four strings of light 76 which progressively light as through the field 68. The next field, i.e., the pink field 70, might include, for example, three strings of lights 76. The object of the game, is to get to the top of the volcano before the game 10 or 100 times out, if possible. The player receives a ticket or a prize depending upon the cumulative score he or she has received. Again, as previously described, the player has the option of picking up where he or she left off at the end of the first game, if he or she places a coin or token in the coin slot 20 within an adjustable seven second grace period at the end of the 25 second play of the first game.

According to the alternative embodiment of the invention 100, if a player strikes a target 28, 30 or 32 that is green during play, then the cumulative score moves upward. If, however, a target 28, 30 or 32 is struck while it is illuminated with a red light, then the cumulative score decreases and the player may actually find himself or herself moving down the scoring fields 68, 70, 72 or 74 that comprise the volcano-like simulation 18. If a player strikes one of the side targets 34 or 36 during the play of the game, the value of the illuminated targets 28, 30 or 32 double.

Figure 9:
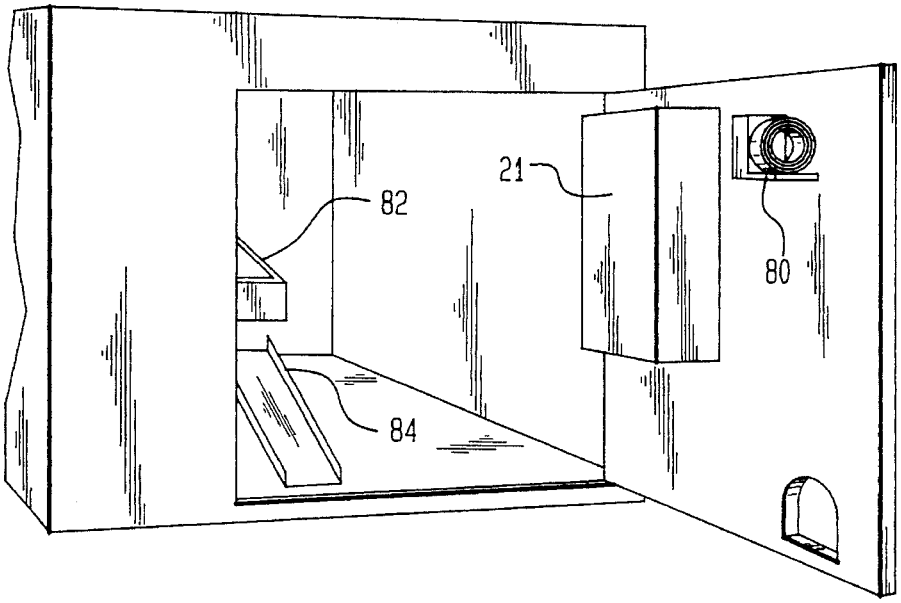
FIG. 9 is a front view of the invention with the access door open revealing the coin mechanism, the ticket dispenser and the prize dispenser.
Figure 10:
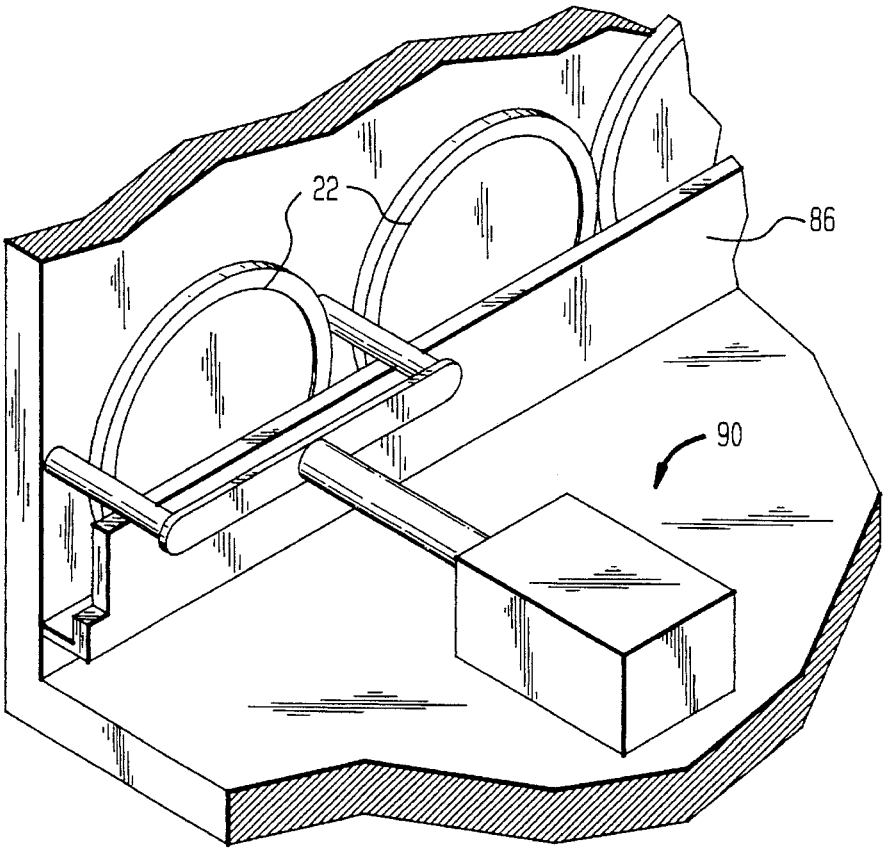
FIG. 10 is a detail view of the solenoid operated puck control end at the bottom of the puck delivery chute.

At the end of the game, the player receives a prize. The prize may be in the form of tickets delivered by ticket dispenser 80 or might be in the form of a packet including a small premium therein. The packets are released by prize dispenser 82 and roll down chute 84 to the player as shown in FIG. 9.

The invention has several advantages over those known in the art.

First, it can be played by one person.

Second, the barrier gate mechanism is especially functional and rugged, thereby permitting the game to be played in an unsupervised location for extended periods of time without additional maintenance. Also, the resilience of the gate causes the puck to return quickly and makes the game harder and more interesting to play.

Third, because many people are familiar with prior art, two player air hockey games, the game is relatively easy to learn and relatively easy to play, even though scoring can be very challenging.

Fourth, the alternative embodiment is exciting to play especially due to the randomized nature of the strikeable target and its interaction with a progressive series of scoring fields.

While the invention has been described with reference to a preferred embodiment thereof, it will be appreciated by those of ordinary skill in the art that modifications can be made to the structure and play of the game without departing from the spirit and scope of the invention as a whole.

What is claimed is:

1. A table game apparatus including a low friction playing surface having a player end, two sides and a goal end opposite said player end, target means proximate said goal end, a slidable projectile for sliding on said playing surface, and a striker for hitting said slidable projectile and driving it from said player to said goal end, the improvement comprising:

barrier means for deflecting said slid able projectile back to said player during play of said game when said barrier means is in a first position and for permitting said slidable projectile to pass under said barrier means at the end of said game when said barrier means is in a second position, said barrier means comprising an inflexible boom having a substantially straight, vertical face and a resilient bumper strip attached to said vertical face of said boom;

a hinge means for connecting said barrier means to said apparatus;

barrier drive means for driving said barrier means between said first and second positions;

a crank means connected to said barrier drive means;

a link means connected between said crank means and said barrier means;

a bin located behind said goal end for collecting said puck when said barrier drive means in said second position;

a chute means for delivering said puck from said bin to the player; and, electronic controller means for controlling said barrier drive means.

2. The apparatus of claim 1 wherein said low friction playing surface includes a plurality of air holes therein, said apparatus further comprising:

an electrically operated blower for providing air to said plurality of air holes so as to form an air cushion for said slidable projectile to glide over.

3. The apparatus of claim 2 wherein said slidable projectile comprises a puck having at least one flat surface for gliding over said playing surface.

4. The apparatus of claim 3 wherein said target means comprises at least two targets located at said goal end.

5. The apparatus of claim 4 further comprising:

scoring means located at the goal end of said playing field for providing an indication of the cumulative score of said game, said scoring means including a scoreboard including multiple, progressive scoring fields.

6. The apparatus of claim 5 further comprising:

randomizing means for changing the value of said targets during the play of said game, wherein the value of a target may increase or decrease the cumulative score of the game depending upon the instantaneous value of said target during game play.

7. The apparatus of claim 6 further comprising:

at least two additional targets located on the sides of said playing field, wherein striking one of said two additional targets during the play of the game increase the value of at least one of said targets at the goal end of said playing surface for a predetermined period of time.

8. The apparatus of claim 7 wherein the cumulative score of the game is displayed on said scoreboard in the form of a progressive score and wherein said score starts with one of said multiple, progressive scoring fields at the bottom of said scoreboard closest to said targets at said goal end and wherein the player attempts to accumulate a score to take the player to the top of said scoreboard and wherein said cumulative score can cause said score on said scoreboard to move up or down within said multiple, progressive scoring fields during play of the game.

9. The apparatus of claim 8 wherein said scoring fields are assembled on said scoreboard in the form of a simulated volcano.

10. The apparatus of claim 9 further comprising:

timer means incorporated in said electronic controller means for controlling the playing time of said game, wherein when said timer means reaches the end of said game said barrier means goes up and said puck is captured at the goal end of said playing surface.

11. The apparatus of claim 10 further comprising:

token operated means connected to said timer means and said electronic controller means for initiating the play of said game.

12. The apparatus of claim 11 wherein said token comprises a coin.

13. The apparatus of claim 12 further comprising:

dispensing means for dispensing a prize in response to the cumulative score at the end of said game.

14. The apparatus of claim 13 wherein said prize is in the form of tickets redeemable for prizes.

15. The apparatus of claim 14 further comprising:

illumination means connected to said randomizing means and said electronic controller means for illuminating at least two of said targets at the goal end of said playing surface with at least two different colors, wherein the color of the illumination of said targets indicates the instantaneous value of said targets during the play of said game.

16. The apparatus of claim 15 wherein said illumination means comprises at least two pair of red and green lights and wherein each pair illuminates one of said targets at said goal end of said game.

17. The apparatus of claim 16 wherein there are three targets at said goal end of said game and three pairs of red and green lights respectively to illuminate said three targets.

18. The apparatus of claim 17 further comprising:

game continuation means for continuing the play of said game if a player places a coin in said coin slot within a predetermined period of time after the end of the play of a game.

19. The apparatus of claim 18 further comprising:

folding means located on said console for folding said console so that it can be shipped.

20. The apparatus of claim 1 further comprising:

a solenoid operated gate means connected to said electronic controller means for selectively delivering a puck from said puck chute to a player.

* * * * *